US005474252A

United States Patent [19]

Schmid

[11] Patent Number: 5,474,252

[45] Date of Patent: Dec. 12, 1995

[54] UNWINDING MACHINE WITH SPLICER

[75] Inventor: Walter Schmid, Stadel, Switzerland

[73] Assignee: Bachofen & Meier AG Maschinenfabrik, Bulach, Switzerland

[21] Appl. No.: 328,257

[22] Filed: Oct. 24, 1994

[30] Foreign Application Priority Data

Oct. 25, 1993 [DE] Germany ..... 43 36 298.2

[51] Int. Cl.[6] ..... B65H 19/18; B65H 19/20

[52] U.S. Cl. ..... 242/554.2; 242/554.4; 242/555.2; 156/159; 156/504; 156/505

[58] Field of Search ..... 242/554.2, 554.3, 242/554.4, 554.6, 555.1, 555.2; 156/157, 159, 504, 505, 506

[56] References Cited

U.S. PATENT DOCUMENTS 4,097,323 6/1978 De Roeck et al. ..... 242/555.2 X 4,624,401 4/1981 Ganz ..... 242/555.2 X 5,316,229 5/1994 Draghetti ..... 242/555.2 X

FOREIGN PATENT DOCUMENTS 2303856 8/1973 Germany .

*Primary Examiner*—John M. Jillions

*Attorney, Agent, or Firm*—Herbert Dubno

[57] ABSTRACT

An unwinding machine for wound rolls, e.g. of paper, has holders which can be swung alternately into the unwinding and the splicing positions. A new roll in the splicing position has its leading end engaged by a groove roller which draws the new web between itself and the old web during continued unwinding thereof and a blade roller is pressed against the groove roller to cut through both webs and attach an adhesive strip across the trailing end of the old web and the leading edge of the new web. The residue of the old web continues to be wound up on the blade roller while a small residue of the new web is picked up by the groove roller and carried away.

14 Claims, 5 Drawing Sheets

UNWINDING MACHINE WITH SPLICER

FIELD OF THE INVENTION

The present invention relates to an unwinding machine with a splicer for attaching a web unwound from one roll to a leading edge of a web to be wound from a new roll. The invention also relates to a method of splicing such webs and/or to a method of operating the unwinding machine.

BACKGROUND OF THE INVENTION

In the unwinding of webs of flexible material, e.g. paper or paperboard, it is frequently desirable upon replacement of the wound roll or the substitution in the machine of a new fully-wound roll for a roll which has been unwound, to splice the trailing portion of a previously unwound web with a leading portion of the web unwound from the new roll. It is desirable that the splicing be carried out at full unwinding speed, i.e. without braking or stopping the trailing portion of the web and also to effect the splicing in a butt junction, i.e. without overlapping the trailing portion of the web with the leading portion of the new web. The advantage of a butt connection over an overlap connection is that unnecessary thickening of the web can be obviated, such thickening creating problems in many cases in the subsequent operations with the web. The subsequent operations to which the web may be subjected after unwinding can include, for example, coating.

In order to form a butt connection without slowing the speed of the web during the unwinding process, German patent document DE-OS 23 03 856 describes a splicing unit in which the trailing portion of the web previously unwound from a roll is passed together with the leading portion of the new web about a grooved roller and the webs are cut on the grooved roller by the blade of a blade roller resting against the grooved roller. After the cut residue of the trailing web is separated from the leading portion of the new web, an adhesive strip is applied to connect the newly-formed leading edge of the new web with the newly-formed trailing end of the previously unwound web. The adhesive strip can be laid into a groove in the blade roller before the beginning of the splicing operation and can be transferred to the webs from this groove.

To guide the leading end of the new web through the splicing unit, a separate winding roller engages the leading end of the web from the new roll and passes it through the gap between the grooved roller and the winding roller, whereby the new web is wound in an intermediate winding on the winding roller. To separate the two webs, i.e. sever them in the manner described, the groove roller is moved against the blade roller. The material from the leading end which remains wound on the winding roller is treated as lost material and is ultimately removed from the winding roller.

Prior art unwinding apparatus was characterized by complex mechanisms and high materials loss.

OBJECTS OF THE INVENTION

It is, therefore, the principal object of the present invention to provide an improved apparatus for the unwinding of a web, whereby the loss of material can be minimized and the apparatus and operating cost can be reduced by comparison with earlier systems.

Another object of this invention is to provide an unwinding machine for the purposes described which can be fabricated at low cost, is highly reliable, and suffers substantially less loss in the web material unwound from the roll.

Still another object of the invention is to provide an improved method of unwinding webs of flexible material from respective rolls or an improved method of operating a web unwinding machine.

SUMMARY OF THE INVENTION

These objects and others which will become apparent hereinafter are attained, in accordance with this invention, in a web unwinding machine having at least two holding devices for a respective roll wound with the web material and alternatively displaceable into an unwinding position and a splicing position respectively, and a splicing device for the webs from the two rolls.

According to the invention the splicing device can include a blade roll with a peripherally projecting blade, a groove roll with at least an axial groove, means for passing the web from the roll in the holder in its web unwinding position and a web newly drawn from the roll in the splicing position through the gap between the blade roller and a groove roller whereby the blade roller and the groove roller can be brought toward one another and synchronously driven to cause the blade to penetrate through the webs and into the groove of the groove roller, and means for enabling the groove roller to be pressed against the roll in the splicing position so as to enable the groove roller to pick up the leading end of the new web and draw it through the aforementioned gap.

The method of the invention thus is distinguished in that the trailing web is drawn through the gap above the new web while the two webs lie along the groove roller so that engagement of the blade into the webs as they are disposed on the groove roller, will sever the residue of the trailing web and the leading end of the new web and provide cut edges of the new web and the trailing web which abut against and are spliced together with an adhesive strip on the groove roller.

The apparatus thus can comprise:

means forming two roll holders alternatingly displaceable between a splicing position and an unwinding position;

means forming a path of a web unwound from a roll in the unwinding position and extending past a roll in the splicing position;

a blade roller along the path having a web-severing blade projecting from a periphery of the blade roller;

a groove roller along a side of the path opposite the groove roller across the web, the groove roller having at least one axially extending groove positioned to receive the blade, the means forming the path including means for guiding the web unwound from the roll in the unwinding position and a new web unwound from the roll in the splicing position between the blade roller and the groove roller;

means for displacing the blade roller and the groove roller relatively and synchronously driving same to urge the rollers against the webs and press the blade through the webs into the groove; and means for displacing the groove roller toward the roll in the splicing position for picking up a leading edge of the new web therefrom and drawing the new web between the groove roller and the blade roller.

The method can comprise the steps of:

(a) continuously unwinding a roll wound with a web in an unwinding position and supported by one of two roll holders alternatingly displaceable between a splicing position and an unwinding position;

(b) guiding the web unwound from a roll in the unwinding position past a roll in the splicing position;

(c) picking up a leading end of a new web from the roll in the splicing position on a groove roller and entraining the new web on the groove roller through a gap between the groove roller and a blade roller and through which the web unwound from the roll in the unwinding position passes; and (d) while the webs are continuously displaced through the gap, pressing the webs between the blade roller and the groove roller to drive a blade of the blade roller through the webs into a groove of the groove roller, thereby severing the webs and applying an adhesive strip across a leading edge of the new web and a trailing edge of the web unwound from the roll in the unwinding position.

With the invention, no separate winding roller is required. Rather, the groove roller carries off the severed portion of the leading end of the new web so that minimum losses thereof can be ensured.

When the blade roller is moveable against the groove roller, the blade is forced through the webs to sever them. This ensures during the cutting operation the absence of band lengthening or stretching tension resulting from the cutting action. By providing, moreover, a pressing roller downstream of the gap and positioned to press against the groove roller, I can ensure a reliable bonding of the adhesive strip against surfaces of the two webs which adjoin at the butt joint. A sensor is trained upon the groove roller downstream of this pressing roller and the gap to enable the leading end of the web to be detected, at least with respect to its position, again contributing a limitation in the length of the excess which must be cut off at the leading end of the web.

The groove roller can have a pair of diametrically opposite grooves which can enable the splicing with only a half turn of the groove roll thereby increasing the speed with which splices can be formed. The groove and blade rollers can have suction openings on one or both sides of the groove or blade to enable the residue of the trailing web to be wound upon the blade roller a limited residue at the leading ends to be collected by the blade roller and the groove roller, respectively, for subsequent disposal after the splicing process. By providing another set of splicing elements on the opposite sides of the groove roller, splicing can be effected independently of the direction in which the unwinding roll has previously been wound.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
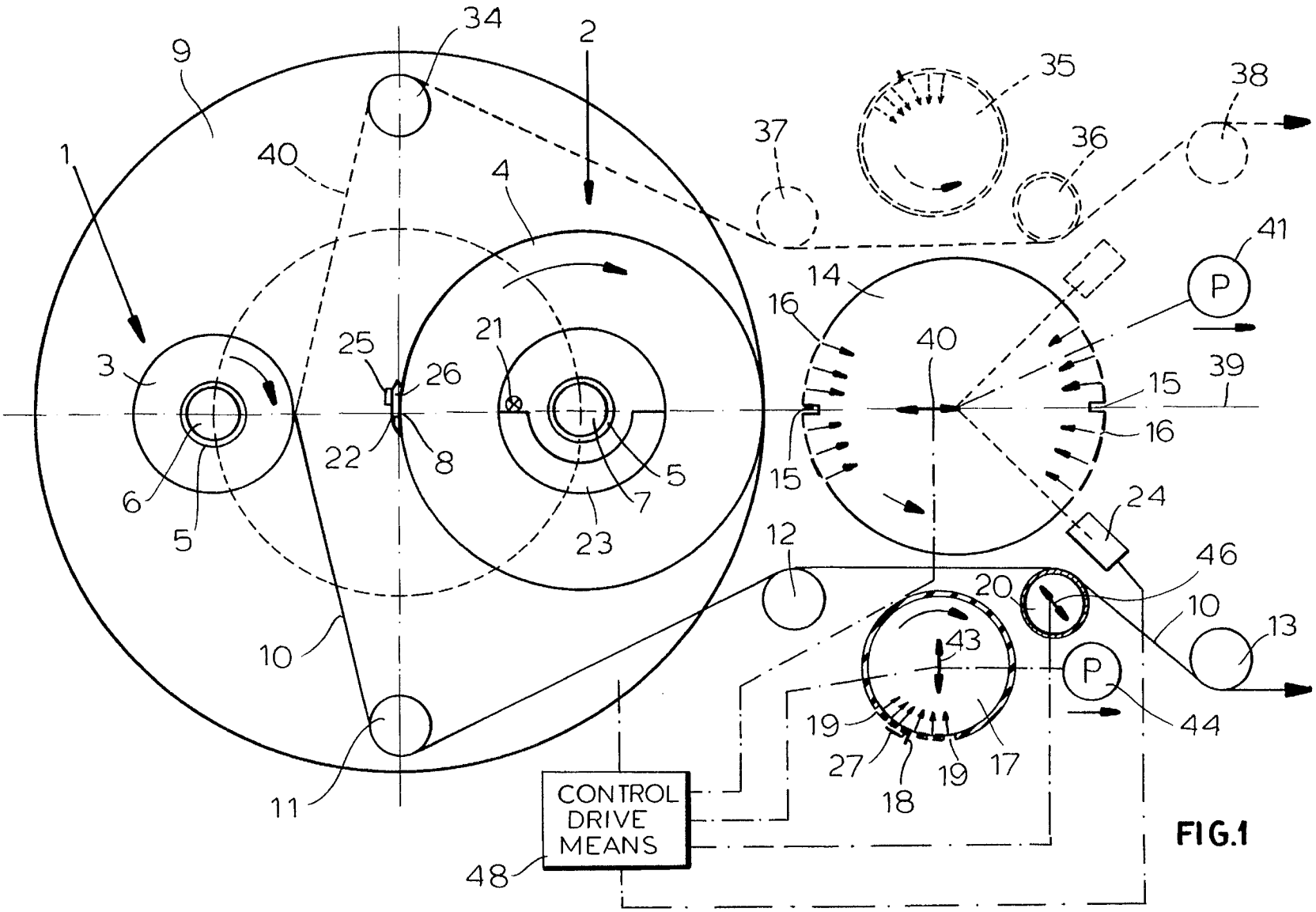
FIG. 1 is a highly diagrammatic side view of an unwinding machine with a splicer according to the invention.
Figure 5:
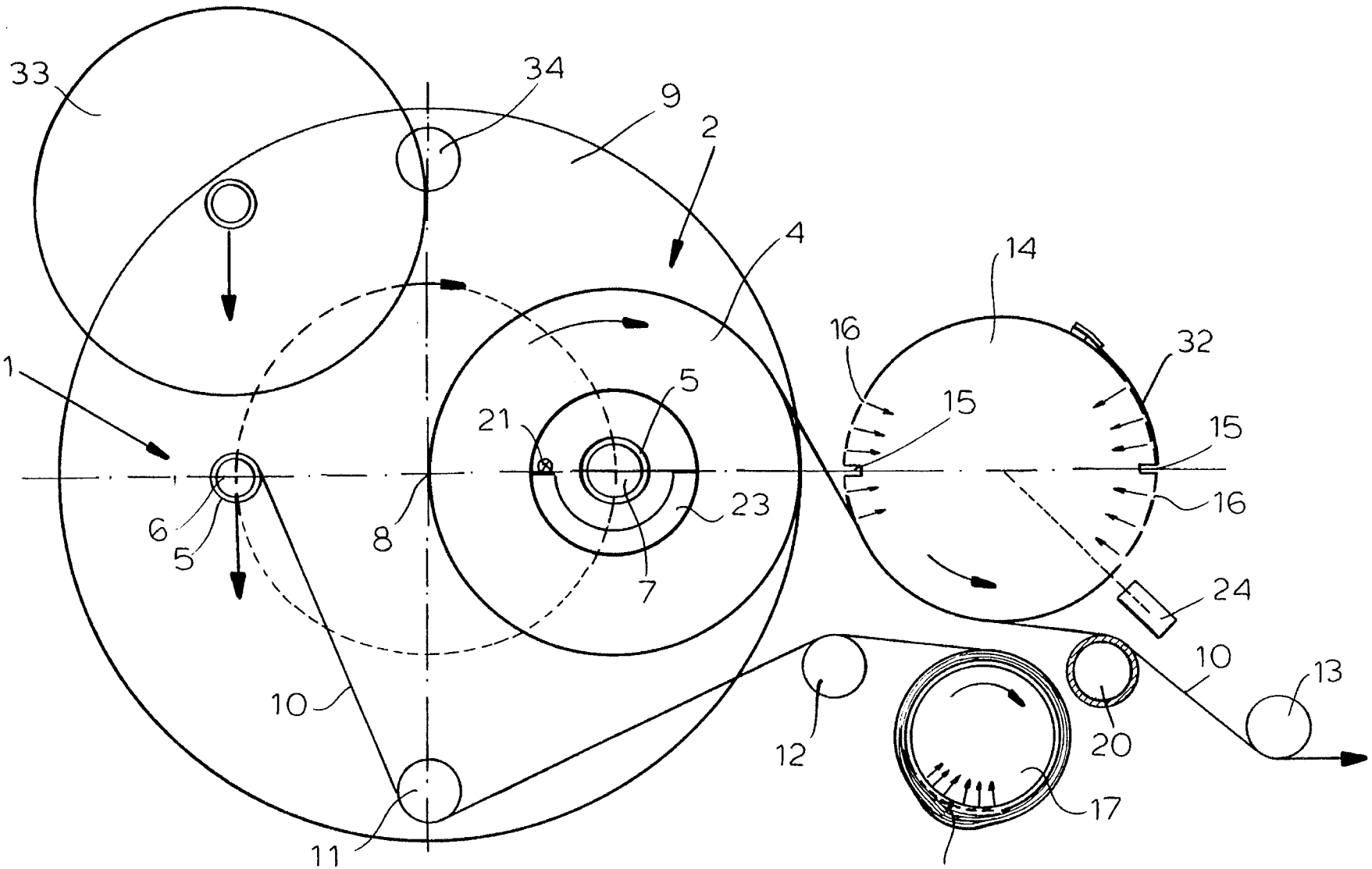
FIG. 5 is a view similar to FIG. 3 showing the apparatus after a completed splice.

The unwinding apparatus illustrated in the drawing comprises at least two holders 1, 2 for respective rolls 3, 4 to be unwound and which are swingable so that they alternately lie in each of two operating positions, namely, an unwinding position and a replacement or splicing position. IN FIG. 1, for example, the roll 3 is shown in the unwinding position along with its holder 6 while the roll 4 is shown in the changed position or the splicing position with its holder 7. In FIG. 5 a change in positions is about to occur, with the roll 4 about to be rotated clockwise into the winding position and a new roll 33 about to be inserted into the holder 6 and to be swung into the change position or the splicing position.

The holders 6, 7 can be respective heads which engage in the core sleeves 5 of the respective rolls 3, 4 and are axially shiftable perpendicular to the plane of the paper in FIG. 1 to engage in the opposite ends of the respective cores. The holders 6 and 7 thus form clamping heads which can be mounted on a pair of side walls, one of which can be seen at 9, or respective support arms for rotation about the center of the side walls 9.

As previously noted, with the apparatus in the position shown in FIG. 1, a new wound roll 4 is in the splicing position of holder 2 while the almost spent wound roll 3 is in the unwinding position engaged in holder 1.

The web 10 drawn from the unwinding roll 3 passes around guide rollers 11, 12 and 13 and past the fully wound roll 4 at the holder 2 in the change position before being supplied to a web processing station, for example, a coating device.

Above the withdrawn web 10 downstream along the path thereof and toward the splicing position of holder 2, a groove roller 14 is provided and is movable by appropriate drive means radially with respect to the roll 4, such means being represented by the double-headed arrow 40. In this case, the groove roller 14 is movable horizontally and can press against the wound roll 4.

The groove roller 14 is provided along its periphery with two opposite axial grooves 15 and preferably at least in regions adjoining the axial grooves 15, with peripheral suction openings 16 connected to a suction pump 41.

Below the groove roller 14 I provide a blade roller 17 having an axially-extending blade groove 42 in which a respective blade 18 is received, the blade 18 projecting beyond the periphery of the blade roller 17 (see FIG. 4).

The blade roller 17 can be movable radially against the groove roller 14 by appropriate means represented by the double-headed arrow 43 and the rolls can be rotated synchronously so that the grooves 15 register with the blade 18, thereby enabling the blade to sever the webs as will be described in greater detail hereinafter.

The peripheries of the rollers 14 and 17 are provided with foam rubber coatings. Suction openings 19 flank the blade groove 42 of the blade roller 17 and the blade roller is evacuated by suction means represented by the vacuum pump 44.

Offset in the web travel direction (arrow 45) from the gap between the rollers 14 and 17, is a pressing roller 20 which is provided with means 46 enabling that pressing roller to be urged against the groove roller 14, the web 10 passing over the pressing roller 20.

The web 10 is so fed that it initially passes under the first guide roller 11 journaled on the swingable side walls 9. The web then passes beneath or around the full roll 4 in the splicing position to the vertically adjustable guide roll 12 and then through the gap between the groove roller 14 and the blade roller 17 to the pressing roller 20. The pressing roller 20 deflects the web 10 away from the groove roller 14 to the guide roller 13.

The control means 48 for the various drives described can receive an input from a stationary optical sensor 21 which can detect a control disk 23 adjustably mounted at the end of each roll 4 to signal the peripheral location of the leading edge 22 of the web on a new roll. The sensor 21 is trained upon the disk 23 and can signal when the leading edge 22 is a half rotation from the groove roller 14. A further optical sensor 24 is arranged directly downstream of the pressing roller 20 and trained against the grooved roller 14 to detect the engagement of the web leading end 22 affixed to the groove roller 14.

A change of the rolls at full unwinding speed is effected by the method described below with this apparatus.

While a web 10 continues to be unwound from the roll 3 suspended in the holder 1 in the unwinding position, a new fully wound roll 4 is suspended in the holder 2 in the change or splicing position. The new fully wound roll 4 is prepared for the splicing step by applying a double-sided adhesive strip along the exterior of its leading end 22, this strip extending over the entire width of the web and hence the entire length of the wound roll 4.

So that the leading end 22 can be detected subsequently by the optical sensor 24 after it has been secured to the groove roller 14, on the inner side of this double-sided adhesive tape, a reflective foil 22 can be applied or a reflective foil 26 can have been originally applied to the inner surface of the free end 22 so that it rests with its exposed surface loosely on the wound roll 4.

In the groove of the blade roller 17 downstream of the blade 18 in the direction of rotation of the blade roller, an adhesive strip 27 is inserted and is bent so that its adhesive side is outward and substantially half of the strip extends into the groove while the other half lies along the periphery of the blade roller adjacent the groove. If the adhesive strip 27 must be held in place, a suction can be generated in the blade roller 17. A suction can also be generated in the groove roller 14 in the manner described and the apparatus is then in the position shown in FIG. 1 prior to start of the splicing process.

Initially the splicing device consisting of the groove roller 14, the blade roller 17, the pressing roller 20 and the guide roller 12 is shifted toward the fully wound roll 4 until a minimum gap remains between the grooved roller 14 and the fully wound roll 4. The pressing roller 20 is then urged into the grooved roller 14 so that the web 10 is partly slung around the grooved roller 14. The fully wound roll 4, the groove roller 14 and the blade roller 17 are then accelerated to the peripheral speed of the web 10 with the fully wound roll 4 and the blade roller 17 rotating in the same sense and the groove roller 14 in the opposite sense from the roll 3. The rotary movement of the blade roller 17 is so synchronized with the rotary movement of the groove roller 14 that the blade 18 will enter the groove 15 of the groove roller 14 to sever the webs.

Figure 2:
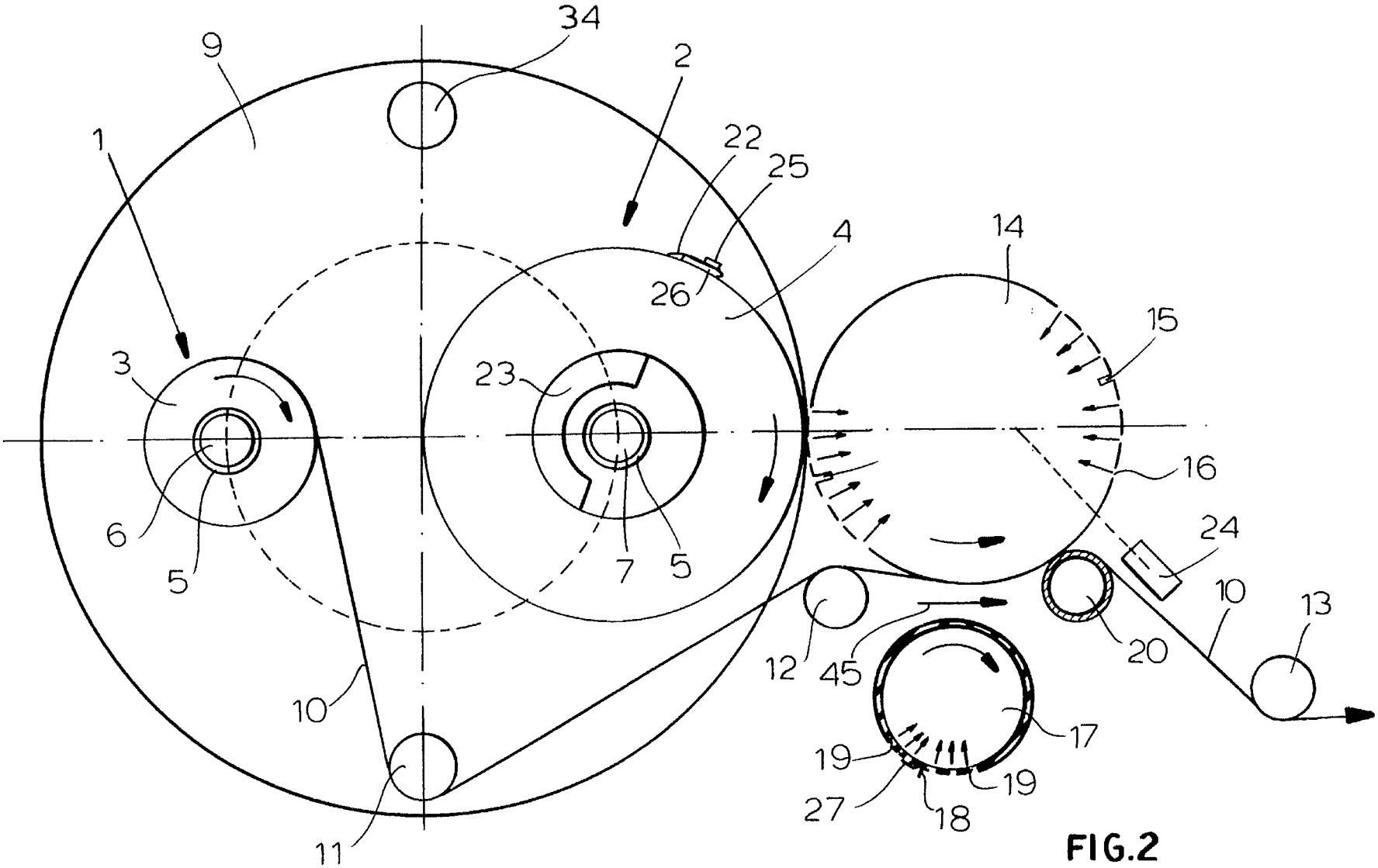
FIG. 2 is a diagram of the positions of the parts at the beginning of the splicing process.

At the start of the change sequence, the groove roller 14 is pressed against the fully wound roll 4. This is effected when the sensor 21 determines that the web end 22 is opposite the groove roller 14 and thus that the adhesive strip 25 can be correctly engaged by the groove roller 14 (FIG. 2). The starting end of the web is then entrained through the gap between the fully wound roll 4 and the groove roller 14 and the groove roller 14 synchronously driven with the roll 4 and having the end 22 bonded thereto by the adhesive strip 25, entrains the web through the gap between the groove roller 14 and the blade roller 17.

Figure 3:
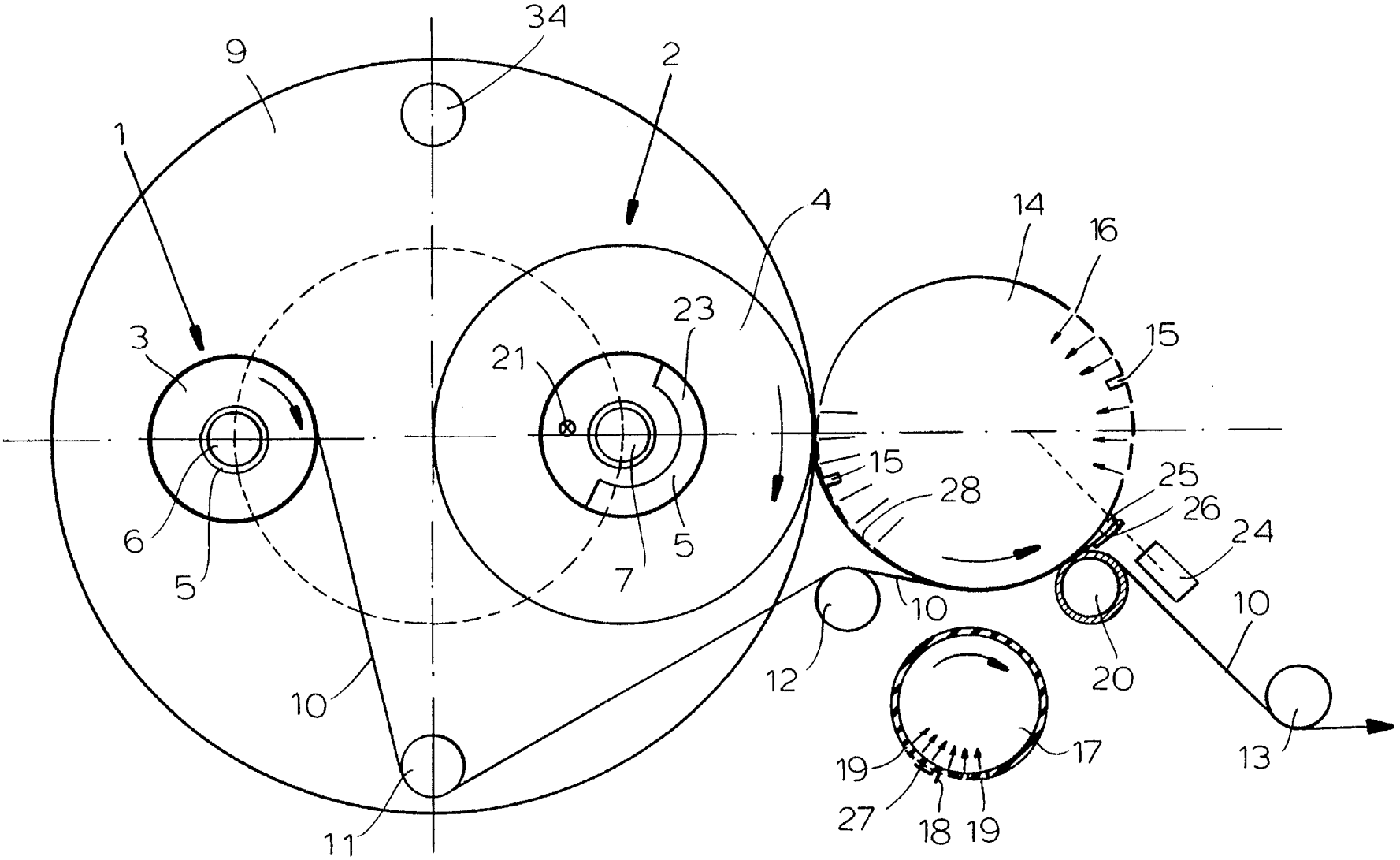
FIG. 3 is a diagram of the apparatus prior to the separation of the two webs.

As soon as the leading end 22 is detected by the optical sensor 24 directly downstream of the pressing roller 20 (FIG. 3), the blade roller 17 is driven upwardly to press the web 10 and the new web 28 against the groove roller 14. At this instant the blade 18 can pass into the respective groove 15 to sever the two webs.

Figure 4:
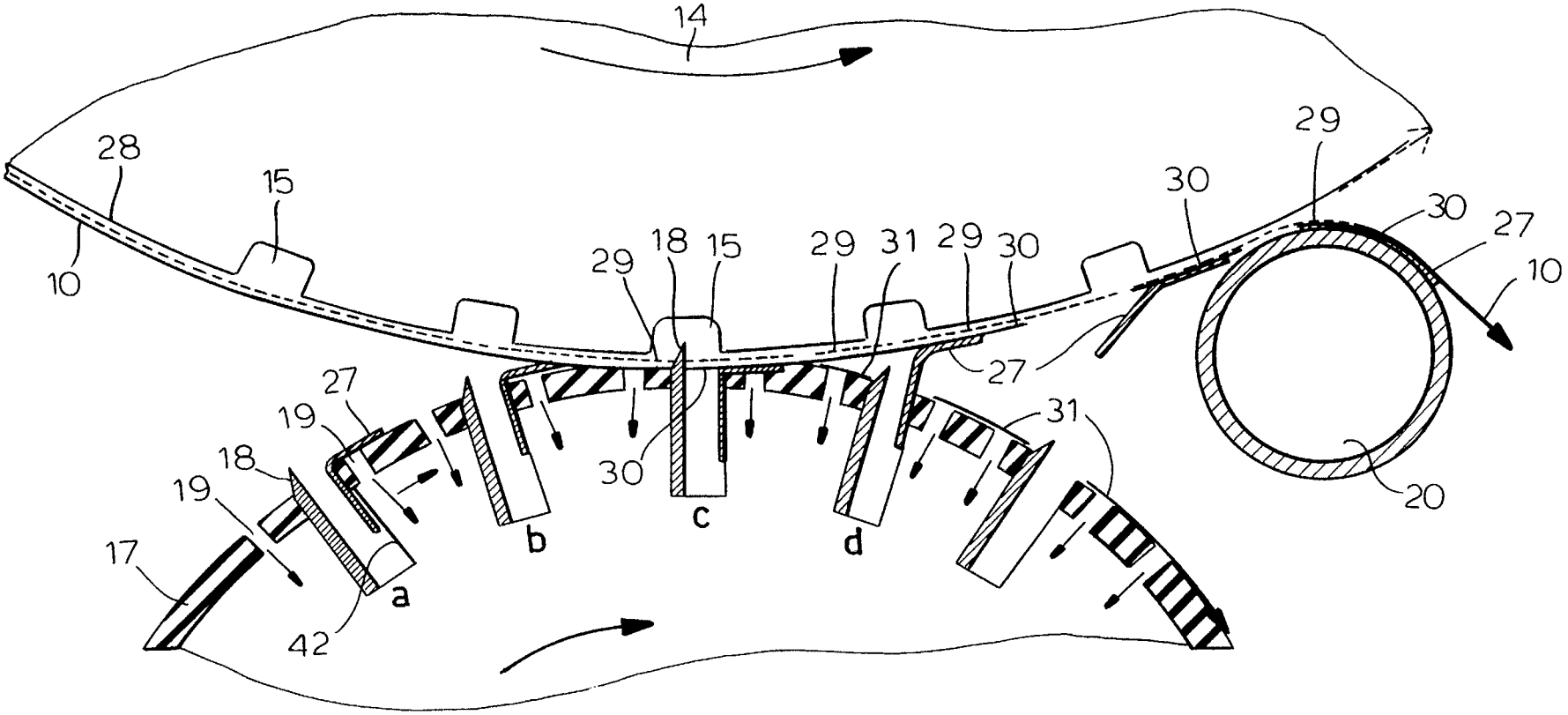
FIG. 4 shows in greater detail and drawn to a larger scale, the cutting operation and the use of the splicing tape or strip.

FIG. 4 shows highly diagrammatically a sequence of blade positions illustrating how the two webs 10 and 28 are simultaneously cut and the newly formed web end 30 of the trailing web 10 abuts the commonly formed leading edge 29 of the new web 28 without overlapping.

The inner new web 28 and the outer trailing web 10 are bonded together by the adhesive strip 27 which was originally held in place by vacuum (position a) and initially bonds to the outer web 10 (position b) before the blade cuts through the webs. After the blade cuts through the webs (position c), over the entire width thereof, a new leading edge of the new web 28 and a new end 30 of the trailing web 10 are formed. The adhesive strip 27 is half bonded to the new web end 30.

Upon further rotation of the groove roller 14 and the blade roller 17 (into position d), the new web end draws the adhesive strip 27 out of the groove of the blade roller 17. The residue 31 of the trailing web 10 adheres to the blade roller 17 because of the suction applied thereto and is drawn downwardly to follow the blade roller 17, thereby liberating the new leading edge 29 of web 28 so that it can be engaged by the adhesive strip 27. As the adhesive strip passes between the pressing roller 20 and the groove roller 14, the adhesive strip 27 is pressed against the leading edge 29 of the new web 28 and is bonded thereto.

The web 10 to which the new web 28 is now attached, passes over the pressing roller 20 and is deflected away from the groove roller 14 and fed to a further processing stage, e.g. a device for bonding a cover strip thereto, while the cutoff leading end portion 32 of the new web 28 remains as a residue upon the groove roller 14.

After the webs 10 and 28 have been secured together, as can be seen from FIG. 5, the blade roller 17 is moved away from the groove roller 14 downwardly and the remainder of the web 10 is drawn off the roll 3 onto the blade roller 17. The holder 1 and the blade roller 17 are then stopped. The splicing unit is moved away from the new roll 4 so that the groove roller 14 no longer bears against it.

The empty sleeve 15 is removed from the holder 1 and a new fully wound roll 33 is suspended therein. The residue of web accumulated on the blade roller 17 is then removed therefrom. The new roller 33 is then swung on the plates 9 through 180° in the clockwise sense after the application of the adhesive to its leading end of its web and the application of the reflective foil thereto until the holder 1 with the new roll 33 is in the splicing position and the roll 4 from which the web is being withdrawn is in the unwinding position.

The guide roller 34 assumes the previous position of the guide roller 11 and deflects the web 28 downwardly after the roller 4 has replaced the roller 3 in its unwinding position. The groove roller 14 is stopped and the paper residue 32 thereon is removed, the unwinding device being then prepared for the insertion of a new adhesive strip in the groove of the blade roller 17 for the next splicing operation.

FIG. 1 shows with broken lines a second blade roller 35, a second pressing roller 36 and associated guide roller 37 and 38, mirror symmetrical with respect to the symmetry plane 39 to the rollers 17, 20, 12 and 13, the symmetry plane passing through the center of rotation 8 of the walls 9 and the center of the groove roller 14. With this embodiment, there is a doubling of the splicing elements which enables a change in direction of rotation of the new roll in case of a roll change, i.e. operation of the splicing system regardless of the sense in which the new roll unwinds.

I claim:

1. An unwinding machine for rolls wound with a web to be drawn from said rolls, said unwinding machine comprising:

means forming two roll holders alternatingly displaceable between a splicing position and an unwinding position;

means forming a path of a web unwound from a roll in said unwinding position and extending past a roll in said splicing position;

a blade roller along said path having a web-severing blade projecting from a periphery of the blade roller;

a groove roller along a side of said path opposite said groove roller across said web, said groove roller having at least one axially extending groove positioned to receive said blade, said means forming said path including means for guiding the web unwound from said roll in said unwinding position and a new web unwound from said roll in said splicing position between said blade roller and said groove roller;

means for displacing said blade roller and said groove roller relatively and synchronously driving same to urge said rollers against said webs and press said blade through said webs into said groove; and means for displacing said groove roller toward said roll in said splicing position for picking up a leading edge of said new web therefrom and drawing said new web between said groove roller and said blade roller.

2. The unwinding machine defined in claim 1 wherein said blade roller is mounted for movement toward and away from said groove roller.

3. The unwinding machine defined in claim 1 wherein said means for guiding includes a pressing roller disposed downstream of a gap between said blade roller and said groove roller in a direction of travel of said webs, said pressing roller being displaceable against said groove roller.

4. The unwinding machine defined in claim 3 wherein downstream of said pressing roller a sensor is provided, said sensor being trained on said groove roller for detecting a location of the leading edge of the new web thereon.

5. The unwinding machine defined in claim 1 wherein said groove roller is formed along a periphery thereof with two opposite axially extending grooves.

6. The unwinding machine defined in claim 1 wherein said groove roller is formed with suction openings at least along one side of said groove and is evacuated for drawing a web against said periphery of said groove roller.

7. The unwinding machine defined in claim 1 wherein said blade roller is formed with suction openings at least along one side of said blade and is evacuated for drawing a web against said periphery of said blade roller.

8. The unwinding machine defined in claim 1 wherein said blade roller is formed with a blade groove receiving a portion of an adhesive splicing strip, another portion of said strip lying along a periphery of said blade roller.

9. The unwinding machine defined in claim 1 wherein said blade roller and said guide means form a first set of splicing elements on one side of said groove roller, said machine further comprising another set of said splicing elements on an opposite side of said groove roller.

10. A method of unwinding rolls wound with a web to be drawn from said rolls, said method comprising the steps of:

(a) continuously unwinding a roll wound with a web in an unwinding position and supported by one of two roll holders alternatingly displaceable between a splicing position and an unwinding position;

(b) guiding the web unwound from a roll in said unwinding position past a roll in said splicing position;

(c) picking up a leading end of a new web from said roll in said splicing position on a groove roller and entraining said new web on said groove roller through a gap between said groove roller and a blade roller and through which said web unwound from said roll in said unwinding position passes; and (d) while said webs are continuously displaced through said gap, pressing said webs between said blade roller and said groove roller to drive a blade of said blade roller through said webs into a groove of said groove roller, thereby severing said webs and applying an adhesive strip across a leading edge of said new web and a trailing edge of the web unwound from said roll in said unwinding position.

11. The method defined in claim 10, further comprising the step of applying to said leading end of said new web before said leading end is picked up by said groove roller, an adhesive strip, said groove roller being displaceable against said roll in said splicing position to pick up said leading end with the adhesive strip thereon.

12. The method defined in claim 10, further comprising the step of inserting said adhesive strip partly into a groove in said blade roller accommodating said blade and partly onto a periphery of said blade roller adjacent said blade.

13. The method defined in claim 10, further comprising the step of retaining said leading end on said groove roller upon severing said leading end from said new web by said blade.

14. The method defined in claim 10, further comprising the step of winding onto said blade roller a residue of the web of the roll in said unwinding position.

* * * * *